US006170122B1

(12) United States Patent
Kuo

(10) Patent No.: US 6,170,122 B1
(45) Date of Patent: Jan. 9, 2001

(54) PUSH BUTTON DEVICE FOR RELEASING LOCKING MECHANISM

(75) Inventor: Chung-Hsien Kuo, Taipei (TW)

(73) Assignee: Chaw-Khong Co., Ltd., Taipei (TW)

( * ) Notice: Under 35 U.S.C. 154(b), the term of this patent shall be extended for 0 days.

(21) Appl. No.: 09/001,487

(22) Filed: Dec. 31, 1997

(51) Int. Cl.[7] ..... A45C 13/26
(52) U.S. Cl. ..... 16/405; 16/429
(58) Field of Search ..... 190/115; 16/115, 16/429

(56) References Cited

U.S. PATENT DOCUMENTS 3,522,955 * 8/1970 Warner, Jr. ..... 16/113.1
5,500,981 * 3/1996 Ho ..... 16/115
5,524,503 * 6/1996 Ishikura ..... 16/115
5,692,266 * 12/1997 Tsai ..... 16/115
5,803,214 * 9/1998 Wang ..... 16/115
5,806,142 * 9/1998 Wang ..... 16/115
5,816,374 * 10/1998 Hsien ..... 190/115
5,819,892 * 10/1998 Deliman ..... 16/115
5,926,914 * 7/1999 Kuo ..... 190/115
5,956,807 * 9/1999 Kuo ..... 16/113.1

* cited by examiner

*Primary Examiner*—Anthony Knight
(74) *Attorney, Agent, or Firm*—Tung & Associates

(57) ABSTRACT

The present invention discloses a push button device for releasing a locking mechanism by utilizing a gear wheel engaging a pair of gear faces to assist in the pulling of drive cables for releasing a lock mechanism. The present invention novel push button device can be used in any mechanical devices that has a need for releasing a locking mechanism, and is particularly suitable for use in retractable handle systems for wheeled luggages.

16 Claims, 6 Drawing Sheets

PUSH BUTTON DEVICE FOR RELEASING LOCKING MECHANISM

FIELD OF THE INVENTION

The present invention generally relates to a push button device for releasing a locking mechanism and more particularly, relates to a push button device that is particularly suitable for releasing a locked, retractable handle system used on a wheeled luggage.

BACKGROUND OF THE INVENTION

Wheeled luggage has been popularly used in recent years by travelers in either airplane or any other forms of traveling. In the development of a wheeled luggage, several important and desirable characteristics must be satisfied. First, the luggage needs to be rigidly constructed and to have sufficient rigidity to survive rough handling on the streets, in and out of buildings having ascending or descending steps, and in and out of various forms of carriers such as a motor vehicle, a train or an airplane. Secondly, the wheeled luggage should have adequate wheel means such that a traveler can pull a luggage along on a pavement or other surfaces with relative ease. Thirdly, the wheeled luggage should have a convenient handle system such that it can be stowed securely when not in use.

Wheeled luggage available in the market today do not have reliable means for locking or unlocking a handle system. This creates problems when the luggage is being shipped and handled, for instance, at an airport. When the luggage is positioned sideways or in an upside-down position, the gravity of the handle may extend the handle such that various problems can occur such as damages caused to an automated luggage conveyor system. Efforts have been made by others to remedy the problems. For instance, in U.S. Pat. No. 5,526,908, a retractable handle assembly which can be easily expanded and folded without exerting a large force thereon. The retractable handle assembly includes a hollow bracket mounted on a top plate of one of the half bodies thereof, a pair of lug portions each formed on one of the distal end portions of the bracket and each having a first bore laterally defined therein, a pair of outer tubes each securely mounted between the lug portion and a bottom plate of the half body and each having a second bore laterally defined therein for aligning with the first bore, the pair of inner tubes each is slidably mounted in one of the outer tubes and each having a third bore laterally defined therein for aligning with the second bore, a substantially U-shaped handle portion mounted on the bracket and having two free end portions each engaged with the upper end of a corresponding one of the inner tubes, a pressing member movably mounted in a hollow bracket and including a knob extending through an opening of the hollow bracket, a biasing member mounted on an underside of the present member and including a pair of stubs each respectively extending through the first bore of associated lug portion, the second bore of associated outer tube and the third bore of associated inner tube.

In another issued U.S. Pat. No. 5,499,426, a handle device is disclosed which includes a pair of storage tubes adapted to be mounted on a rear face of a wheeled suitcase, a seat frame, a handle member and a locking mechanism. The locking mechanism is provided in the receiving space of the seat frame and includes two projecting members, a biasing unit between the projecting members for biasing the projection members toward the storage tubes and for locking the handle member relative to the storage tubes when the two engaging holes are in alignment, and a retracting unit for retracting the projecting members to release the handle member relative to the storage tubes. U.S. Pat. No. 5,431,428 discloses a carrying case assembly that is equipped with a collapsible handle assembly disposed within the case, the handle assembly includes a push button which allows the handle to collapse within the case. The handle assembly further includes a lock means for holding the first handle portion in an extended position relative to the second handle portion, the handle lock means includes a selectably releasable handle-locking protrusions on one of the first and second handle portions, movable in opposing directions toward and away from the other of the first and second handle portions into and out of engagement therewith. In still another issued patent, U.S. Pat. No. 5,502,876 a pull handle for a trunk is disclosed which includes a pair of driving rods each having a wedge member disposed at the bottom end thereof and is in abutment with a spring biased locking seat having an oblique cam surface. Each driving rod is housed in a hollow tube and the locking seat is in selective engagement with one of a plurality of spaced retaining slots disposed on a movable sleeve which accommodates each hollow tube.

Referring initially to FIG. 1 where it is shown a conventional retractable handle system 10. The retractable handle system 10 consists of two parallel supporting tubes 12 and a grip 14. The support tube 12 each has a tubular opening 16 for accepting a sliding tube 22. At the upper end of the support tube 12, an aperture 18 is provided for engaging a locking device 24 fixed to the end of the sliding tube 22 through a retractable locking pin 26. The grip 14 consists of a housing grip 20 connected to the sliding tubes 22 which slidingly engaging the tubular openings 16 inside the support tubes 12. At the end of each sliding tubes 22, a locking device 24 is provided which includes a locking pin 26 for locking the grip 14 and the two sliding tubes 22 onto the support tubes 12 through apertures 18. At the center of the grip 20, a push button assembly 28 is provided for controlling the locking devices 24 mounted at the end of the sliding tubes 22. When the push button device 28 is compressed downwardly toward the support tubes 12, it causes the retraction of the locking pins 26 away from the apertures 18 such that the sliding tubes 22 may freely slide in the tubular openings 16 of the support tubes 12.

A perspective view showing the components of grip 14 for the conventional handle assembly 10 of FIG. 1 is illustrated in FIG. 2. The internal structure of the push button device 28 is also shown. The grip housing 20 is constructed by an upper half 38 and a lower half 40. The upper half 38 of the grip housing 20 is provided with an opening 42 for housing the push button 34. The lower half 40 contains a cavity 44 and a shaft 46 affixed to the center of the cavity. The push button device 28 includes a push button 34, a spring 48 and two sliding blocks 36. The push button 34 is fitted to and can move freely upwardly and downwardly through the opening 42 in the upper half 38 of the grip housing 20. The spring 48 is installed on the shaft 46 for supporting the push button 34 such that the top of the push button 34 protrudes over the opening 42. The sliding blocks 36 are installed in the cavity 44 in the lower half 40 and are allowed to move in a longitudinal direction of the grip housing 20. Each of the sliding blocks 36 having an end close to the shaft 46 that is equipped with an inclined surface 50. The other end of the sliding block 36 is connected to a drive device 30. The bottom of the push button 34 is also equipped with two inclined surfaces 56 which engage the inclined surfaces 50 on the two sliding blocks 36 when the push button 34 is compressed downwardly. The engagement between the inclined surfaces 56 and 50 forces the two sliding blocks 36 to move inwardly toward the shaft 46. The inward movement of the sliding blocks 36 causes the drive means 30 to also move inwardly such that the locking device 24 connected to the bottom end of the drive device 30 can be released.

As described above, the operation of the conventional push button device 28 depends entirely on the engagement of the two inclined surfaces 56 situated on the bottom of the push button 34 with the two inclined surfaces 50 situated on the two sliding blocks 36 such that the two sliding blocks 36 are pushed inwardly toward shaft 46 when the button 34 is pressed down. One obvious disadvantage of the system is that when the force applied on the push button 34 is not uniform, the resulting sliding motion of the two sliding blocks 36 situated in cavity 44 is sluggish. This can cause the jamming of the push button 34 in the opening 42 when it is pressed downwardly into the opening at an angle. The non-uniform force applied on the push button 34 may also result in the locking devices 24 located at the bottom end of the two sliding tubes 22 not being unlocked simultaneously. These phenomena causes great inconveniences in utilizing the push button device 28 and furthermore, may cause damage to the device due to the non-uniformly applied forces on the push button 34.

It is therefore an object of the present invention to provide a push button device for releasing a locking mechanism that does not have the drawbacks or the shortcomings of a conventional push button device.

It is another object of te present invention to provide a push button device for releasing a locking mechanism by engaging a push button with a pair of sliding blocks aided by a gear wheel and gear surfaces located on the blocks for improved releasing action of the locking mechanism.

It is a further object of the present invention to provide a push button device for releasing a locking mechanism by engaging a gear wheel with gear surfaces located on a pair of sliding blocks into a rack-and-pinion motion to improve the synchronized action in pulling a pair of drive cables for releasing two locking mechanisms.

It is still another object of the present invention to provide a retractable handle system for a wheeled luggage equipped with a push button device for releasing a locked handle that has an improved operation than a conventional retractable handle system.

It is yet another object of the present invention to provide a retractable handle system for a wheeled luggage equipped with a push button device for releasing a locked handle by utilizing a gear wheel to engage gear surfaces on a pair of sliding blocks that moves in a rack-and-pinion motion for improving the releasing of the locked handle.

It is another further object of the present invention to provide a retractable handle system for a wheeled luggage that is equipped with a releasing device for the handle that does not require the use of a push button.

SUMMARY OF THE INVENTION

In accordance with the present invention, a push button device for releasing a locking mechanism that has improved operation than a conventional push button device by utilizing a gear wheel engaging a pair of gear surfaces to said the pulling of drive cables to release a lock is provided.

In a preferred embodiment, a push button device for releasing a locking mechanism is provided which includes a housing that has an upper half and a lower half for defining a cavity contained therein, the upper half of the housing has an opening therethrough which is adapted for a push button to move up and down freely in the opening, a pair of sliding blocks installed in the cavity of the housing that is capable of moving only in a longitudinal direction of the housing, each of the sliding blocks has a leg portion extending toward each other and an inclined top surface mirror imaged to each other, each of the leg portion has a gear face provided in its surface that faces the other leg portion adapted for engaging a gear wheel, each of the sliding blocks is further adapted to pull a drive cable toward the opening in the upper half of the housing, and a push button positioned in the opening of the upper half of the housing which has a pair of inclined surfaces on its bottom surface adapted for engaging the inclined surfaces on the two sliding blocks, such that when the push button is pushed in a downward direction into the opening, the inclined surfaces on the bottom of the push button engage the inclined surfaces on the two sliding blocks and thereby pulling the blocks toward each other while the synchronized motion is aided by an engagement between the gear wheel and the gear surfaces on the two leg portions of the blocks in a rack-and-pinion mechanism such that a pair of drive cables are pulled toward the push button and thus releasing the locking mechanism.

In another preferred embodiment of the present invention, a retractable handle system for a wheeled luggage that is equipped with a push button device for releasing a lock handle is provided which includes a handle system that has a grip and a pair of retractable/extensible support tubes connecting the grip to a body of a wheeled luggage, a grip consisting of an upper half and a lower half defining a cavity contained therein, the upper half has an opening therethrough adapted for a push button to move up and down freely in the opening, a pair of sliding blocks situated in the cavity of the grip capable of moving only in a longitudinal direction of the grip, each of the sliding blocks has a leg portion extending toward each other and an inclined top surface mirror imaged to each other, each of the leg portion has a gear face provided in its surface that faces the other leg portion adapted for engaging a gear wheel, each of the sliding block is further adapted to pull a drive cable toward the opening in the upper half of the grip, and a push button positioned in the opening of the upper half of the grip which has a pair of inclined surfaces on its bottom surface adapted for engaging the inclined surfaces on the two sliding blocks such that when the push button is pushed in a downward direction into the opening, the inclined surfaces on the bottom of the push button engage the inclined surfaces on the two sliding blocks and thereby pulling the blocks toward each other while the synchronized motion is aided by an engagement between the gear wheel and the gear surfaces on the two leg portions of the blocks in a rack-and-pinion motion so that a pair of drive cables situated in the support tubes are pulled toward the push button and thus releasing a locked handle on the wheeled luggage. The retractable handle system may further include a spring means situated between the push button and the gear wheel to facilitate the returning of the push button to its original unpressed position after the locked handle is released. The gear wheel should have a gear teeth pattern matching that on the opposing surfaces of the leg portions of the sliding blocks such that the sliding blocks can be moved in a rack-and-pinion motion. The angle of the inclined surfaces on the bottom of the push button should be substantially the same as the angle of the inclined surfaces on top of the two sliding blocks.

BRIEF DESCRIPTION OF THE DRAWINGS

These and other objects, features and advantages of the present invention will become apparent from the following detailed description and the appended drawings in which.

DETAILED DESCRIPTION OF THE PREFERRED AND ALTERNATE EMBODIMENTS

The present invention provides a push button device for use in releasing a locking mechanism which can be utilized in any mechanical device and more particularly, in a retractable handle system for a wheeled luggage for releasing a locked handle.

Figure 1:
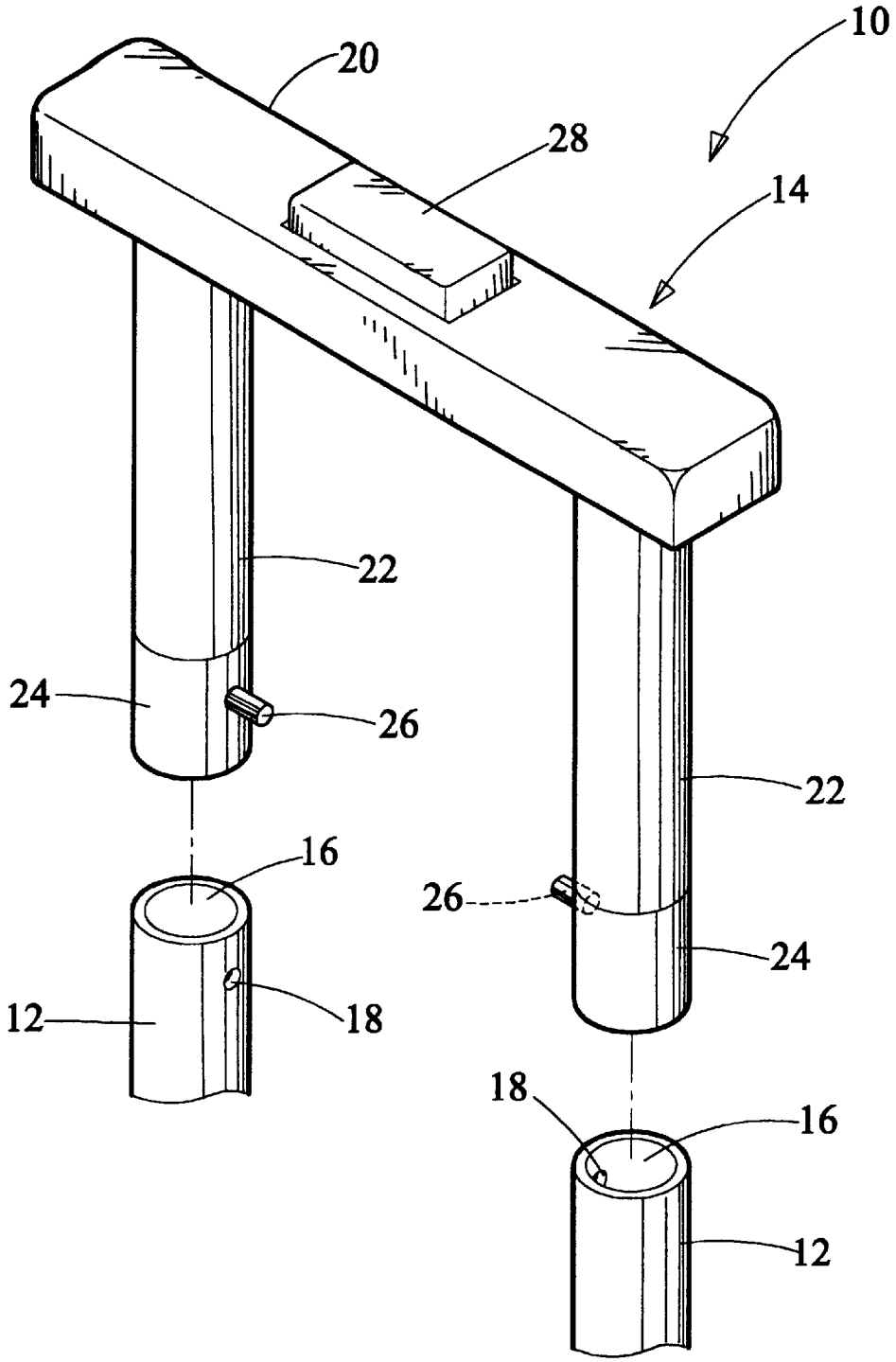
FIG. 1 is a perspective view of a conventional retractable handle assembly for a wheeled luggage.
Figure 2:
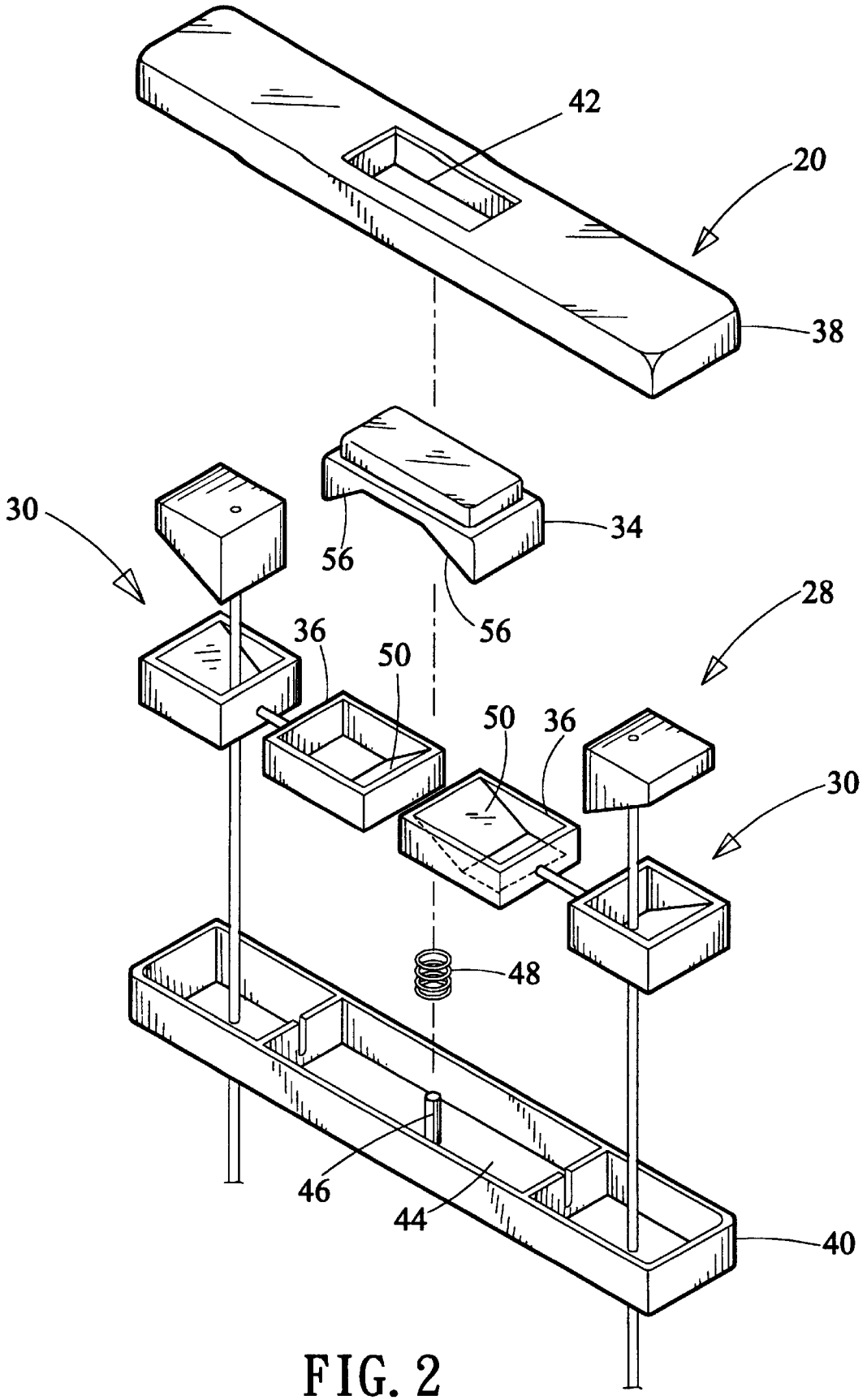
FIG. 2 is a perspective view showing the components of the handle of FIG. 1.
Figure 3:
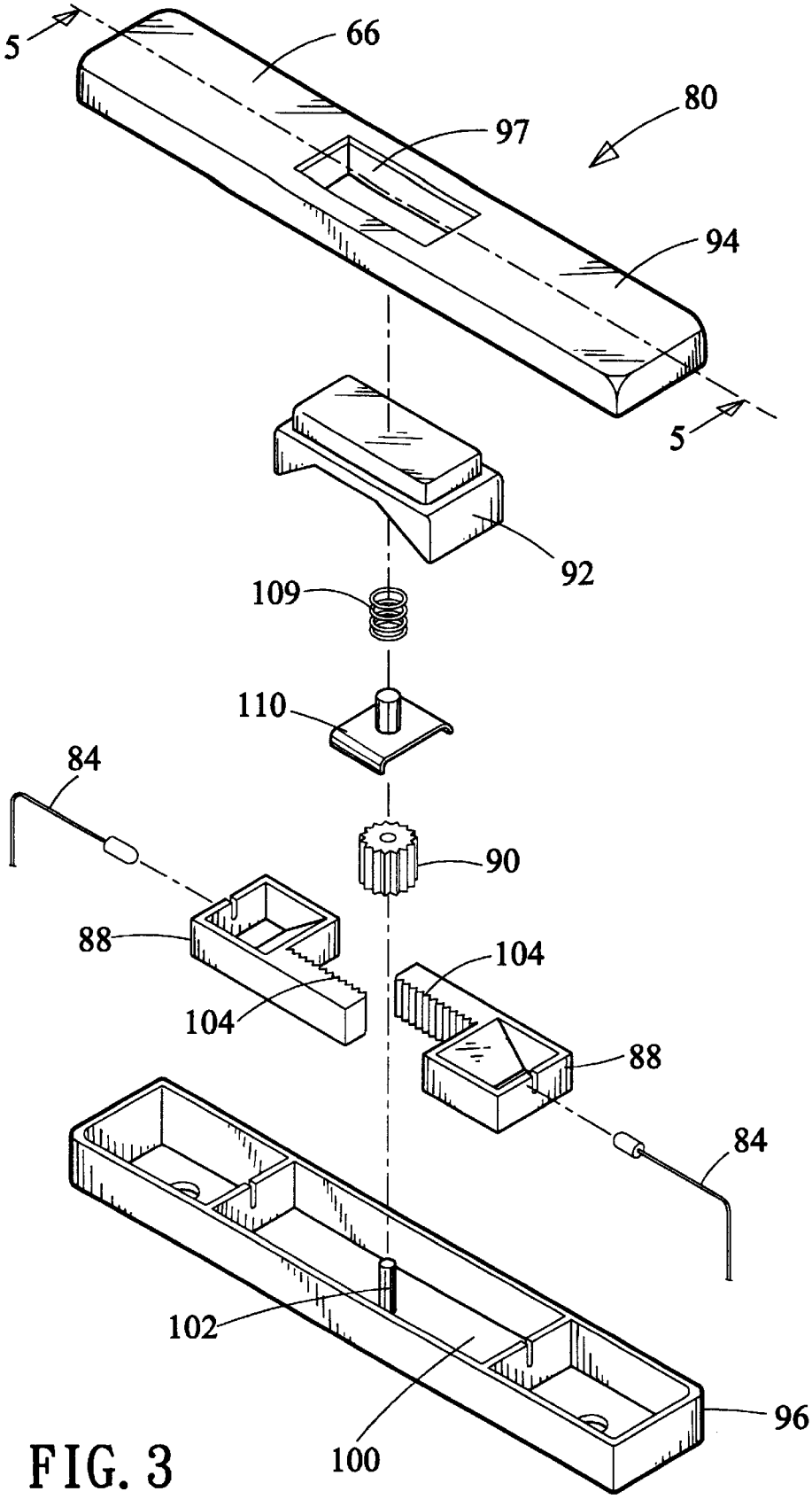
FIG. 3 is a perspective view of the components of the present invention handle system utilizing a push button for releasing a locking mechanism.

Referring now to FIG. 3, where it is shown a present invention push button assembly 80 and its components. The push button assembly 80 is installed in a grip housing 66 which in turn consists of an upper half 94 and a lower half 96. The push button assembly 80 consists of two sliding blocks 88, a gear wheel 90, a spring 109, a spring mounting plate 110 and a push button 92. Inside the lower half 96 of the grip housing 66, a cavity 100 is contained therein which has a shaft 102 affixed at the center of the cavity 100. An opening 97 is provided in the upper half 94 of the grip housing 66 at the center position.

Figure 4:
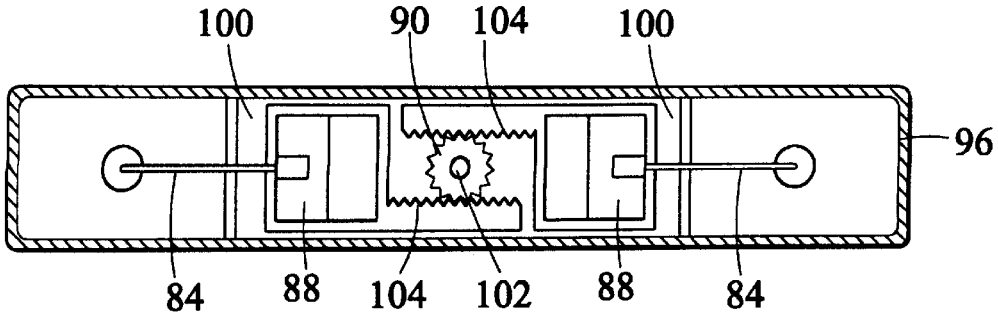
FIG. 4 is a bottom view of the present invention handle system.

FIG. 4 shows a cross-sectional view of the grip housing 66 viewed from the bottom of the lower half 96. It is seen that the two sliding blocks 88 are installed inside cavity 100 on each side of the shaft 102. The sliding blocks 88 can only move in cavity 100 in a longitudinal direction of the grip housing 66. Each of the sliding blocks 88 has a leg portion extended toward the other block and is equipped with a gear face 104 facing the shaft 102 when installed in cavity 100. On the opposite end of the sliding blocks 88 away from the shaft 102, there is a means for connecting drive cables 84 in slots 85. The gear wheel 90 is installed onto the shaft 102 through a center aperture 91 such that it may rotate on shaft 102. The gear teeth pattern on the gear wheel 90 matches the gear teeth pattern on the gear face 104 on the sliding blocks 88 such that they operate together in a rack-and-pinion fashion. The rack-and-pinion operation between the gear wheel 90 and the gear faces 104 further facilitates the inward motion of the sliding blocks 88 when the push button 92 is downwardly pressed. The cooperation between the gear wheel 90 and the gear faces 104 further helps to eliminate problems caused by an non-uniform application of forces on top of the push button 92.

Figure 5:
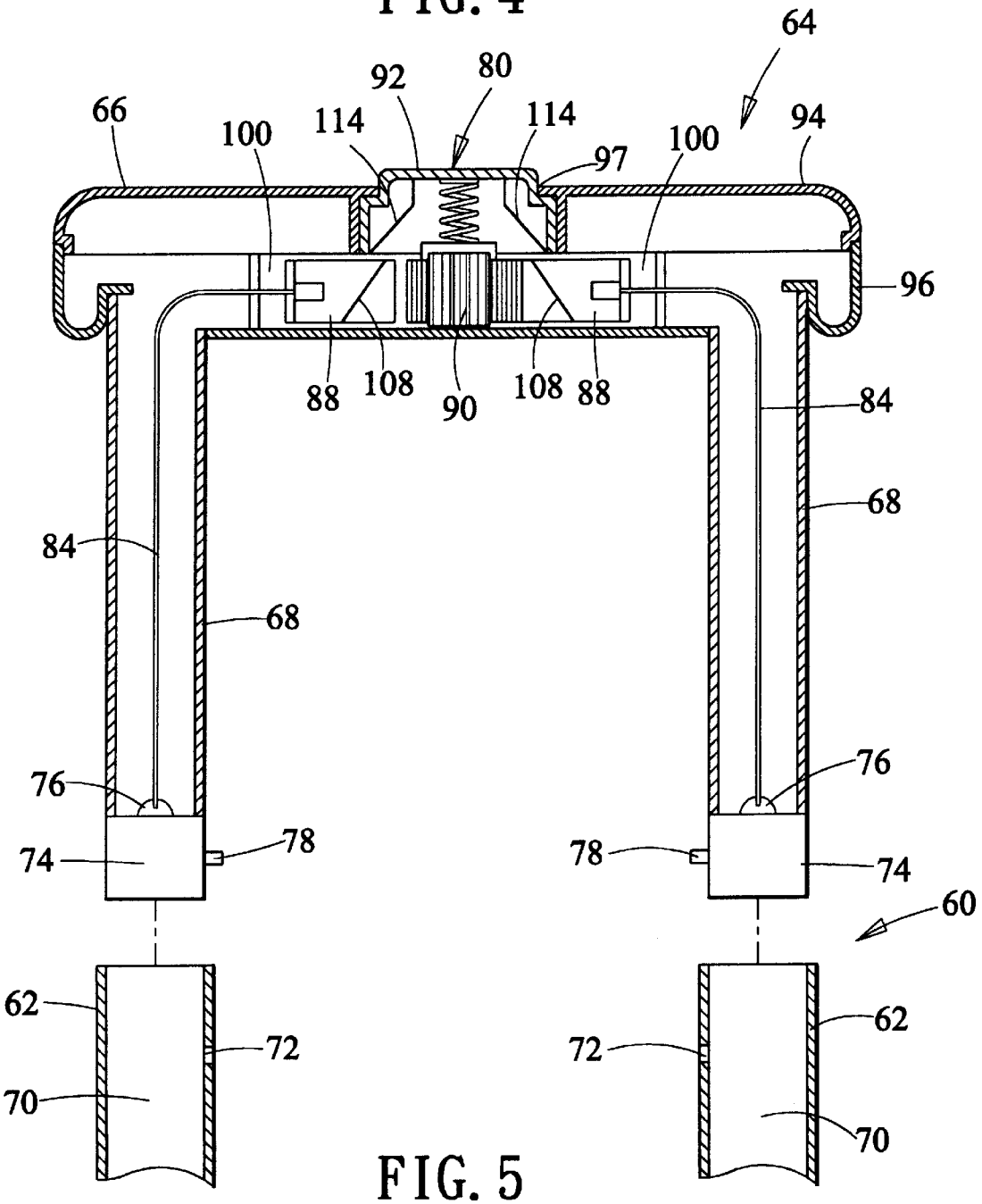
FIG. 5 is a cross-sectional view of the present invention retractable handle system.

Referring now to FIG. 5, where it is shown a cross-sectional view of the present invention handle system 64, taken through section 55 shown in FIG. 3. FIG. 5 shows that the handle system 64 consists of two parallel support tubes 62 and a grip housing 66. The grip housing 66 includes a grip 94 and two sliding tubes 68. Each of the support tubes 62 has a tubular opening 70 for accepting the sliding tubes 68 such that it may slide freely in the opening 70. Each of the support tube 62 is provided with an aperture 72 near the top end of the tube. At the bottom of the sliding tubes 68, a locking device 74 is provided for locking the handle system 64 onto the two support tubes 62 through the engagement of locking pins 78 to the apertures 72.

The push button device 80 is installed in the grip housing 66 of the handle system 64. Two sliding blocks 88 can freely slide in the cavity 100 in a longitudinal direction of the grip housing 66. The push button 92 is installed in the opening 97 situated at the center of the upper half 94 of the grip housing 66 for allowing it to move freely in upward/downward directions. Drive cables 84 are connected to the outer ends of the two sliding blocks 88 at one end, and connected to the locking device 74 at the bottom of the two sliding tubes 68 for operating the locking pins 76 at the other end. On top of each of the sliding blocks 88, an inclined surface 108 is provided in a cavity. The bottom of the push button 92 is provided with two inclined surfaces 114 each corresponding to the inclined surface 108 on the sliding blocks 88. When the push button 92 is pressed downwardly, the two inclined surfaces 114 engages the two inclined surfaces 108 on the two sliding blocks 88 such that the vertical by applied force converts to horizontal motions of the two sliding blocks 88 and the drive cables 84 toward the center of the grip housing 66. The drive cables 84 in turn pulls up the locking pins 78 on the locking device 74 at the end of the sliding tubes 68 such that pins 78 are retracted into the sliding tube locking device 74. This enables the sliding tubes 68 to freely slide in the tubular openings 70 of the supporting tubes 62. When the two sliding blocks 88 are activated by the downward motion of the push button 92 toward the center, gear wheel 90 engages the gear faces 104 located on the two sliding blocks 88 in a rack-and-pinion motion to further enhance a stable movement of the two sliding blocks 88 toward the center of the grip housing 66. The interaction between the gear wheel 90 and the gear faces 104 on the two sliding blocks 88 therefore stabilizes the inward movement of the two sliding blocks 88 and the pulling action of the drive cables 84 even when the force applied on the push button 94 is not uniform.

In the present invention preferred embodiment as discussed above, the push button 92 and the two inclined surfaces 108 on the two sliding blocks 88 interact together for the present invention push button device to function properly. During such function, the two sliding blocks 88 move inwardly and pull on the drive cables 84 with an uniform force to disengage the locking devices 74. With the novel addition of the present invention gear wheel/gear faces assembly and its associated operation, only one inclined surface 114 may be necessary for the bottom of the push button 92 for engaging an inclined surface 108 on one of the sliding blocks 88. This is because the gear wheel 90 engages the gear faces 104 on the two sliding blocks 88 to cause the two sliding blocks 88 to move in opposite directions toward each other even when one of the sliding blocks does not have an inclined surface 108.

Figure 6:
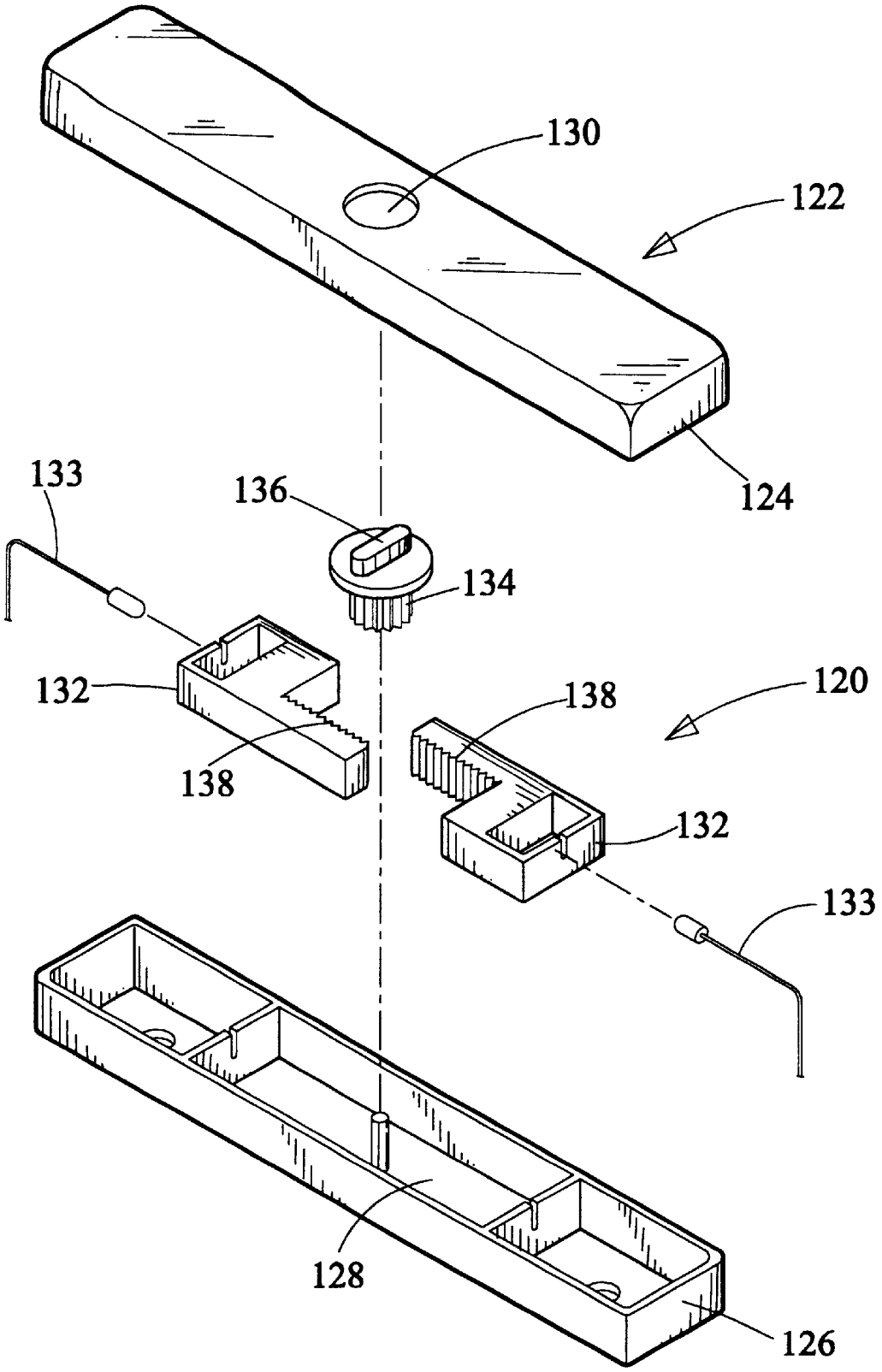
FIG. 6 is a perspective view showing the components used in a second embodiment of the present invention and handle system.

In an alternate embodiment of the present invention, as shown in FIG. 6, push button device 120 is installed in a grip housing 122. The grip housing 122 is constructed by an upper half 124 and a lower half 126. An opening 130 is provided at a center of the upper half 124, while a cavity 128 is provided in the lower half 126 of the grip housing 122. The push button device 120 consists of two sliding blocks 132, a gear wheel 134 and a knob portion 136 integrally connected to the top of the gear wheel 134. The knob portion 136 is used to activate the motion of the two sliding blocks 132 in opposite directions toward each other. The knob portion 136 can be installed such that it protrudes into the opening 130 in the upper half 124 of the grip assembly 122. When the knob portion 136 is turned, the gear wheel 134 is turned simultaneously such that it engages the gear faces 138 provided on the two sliding blocks 132 such that the two sliding blocks 132 move in opposite directions toward each other in the cavity 128 provided in the lower half 126. Drive cables 133 are thus pulled to release the locking mechanism (not shown) of the luggage.

Figure 7:
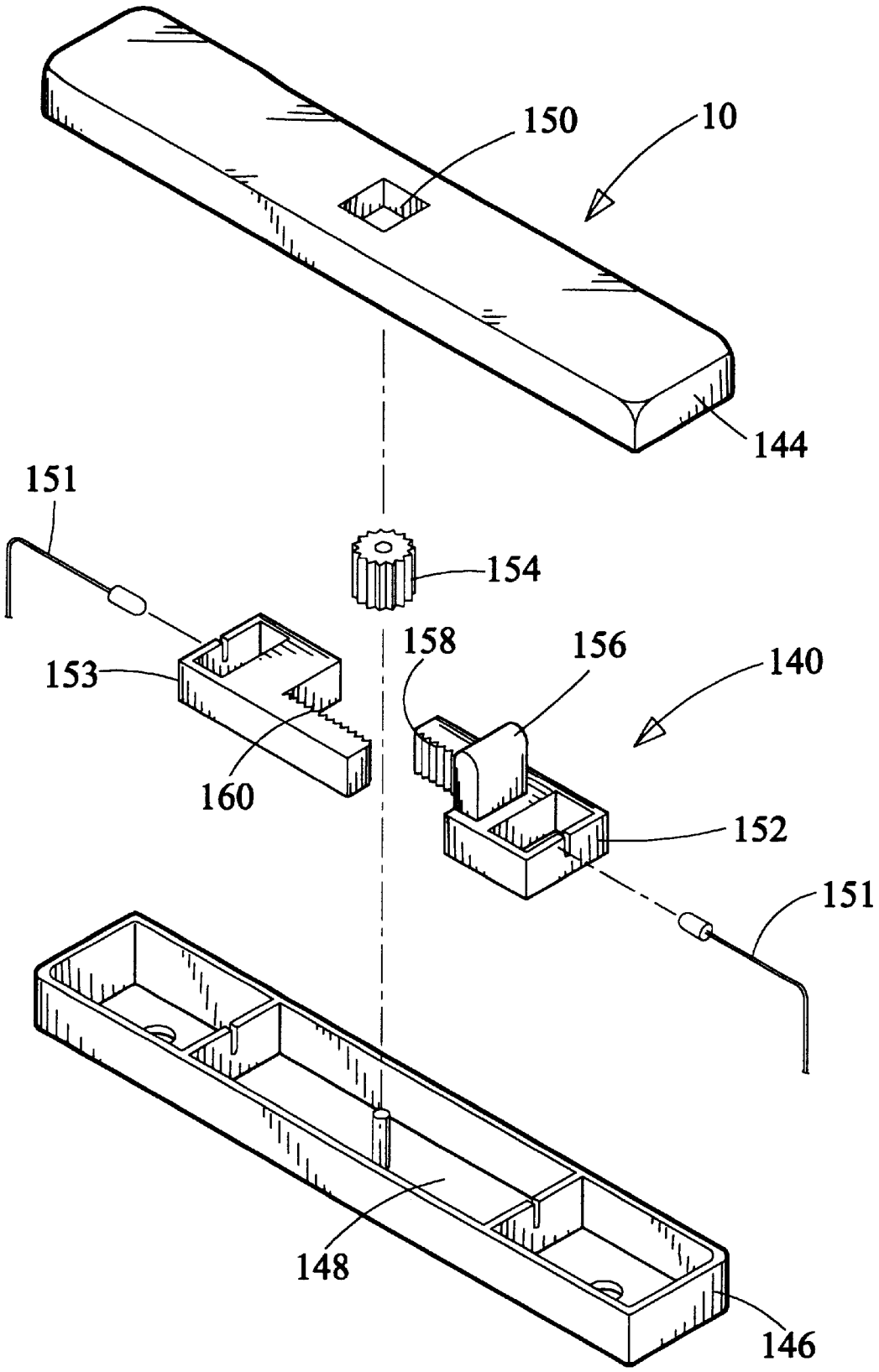
FIG. 7 is a perspective view showing the components in a third embodiment of the present invention handle system.

In still another preferred embodiment, as shown in FIG. 7, a push button device 140 is installed in a grip housing 142. The grip housing 142 is constructed by an upper half 144 and a lower half 146. The upper half 144 has an opening 150 at its center while the lower half 146 has a rectangular-shaped cavity 148 contained therein. The push button device 140 consists of the grip housing 142, two sliding blocks 152 and 153, a gear wheel 154 and a knob portion 156 which is integrally connected to the top of one of the sliding blocks 152. The knob portion 156 is used to trigger the motion of the two sliding blocks 152 and 153 in opposite directions toward each other. The knob portion 156 can be installed in the opening 150 such that it can be operated from the top of the grip housing 142. When the knob portion 156 is moved in a horizontal direction along the longitudinal direction of the grip housing 142, the gear facing 158 on sliding block 152 turns the gear wheel 154 which then engages the gear facing 160 on the other sliding block 153 such that the two sliding blocks moves simultaneously in opposite directions toward each other in the cavity 148 provided in the lower half 146. Drive cables 151 are thus pulled to release the locking mechanism (not shown).

The advantages and benefits provided by the present invention is therefore amply demonstrated by the above illustrated embodiments. With the added rack-and-pinion motion between the gear wheel and the gear faces on the two sliding blocks, the present invention novel push button device avoided the problems existing in conventional push button devices such as the jamming of the push button in the opening, the sluggish operation of the release of the locking mechanism and possible damages to the release mechanism of the locking device. It should be noted that while the present invention is illustrated by a handle system used for wheel luggages, the present invention novel push button device can be used in any other mechanical devices wherein a release from a locking mechanism is desired.

While the present invention has been described in an illustrative manner, it should be understood that the terminology used is intended to be in a nature of words of description rather than of limitation.

Furthermore, while the present invention has been described in terms of a preferred and alternate embodiments, it is to be appreciated that those skilled in the art will readily apply these teachings to other possible variations of the inventions.

The embodiment of the invention in which an exclusive property or privilege is claimed are defined as follows:

1. A push button device for use in releasing a locking mechanism comprising:

a housing comprises an upper half and a lower half defining a cavity contained therein, said upper half having an opening therethrough for a push button to more up and down freely in said opening, a pair of sliding blocks situated in the cavity of said housing capable of moving only in a longitudinal direction of said housing, each of said sliding block having a leg portion extending toward each other and an inclined top surface mirror imaged to each other, each of said leg portion having a gear face provided in a surface that faces the other leg portion, a gear wheel engaging said gear face on said surface of each of said leg portion, a pair of drive cables, each of said sliding blocks is attached to and is capable of pulling one of said drive cables toward said opening in said upper half of housing, and a push button positioned in said opening in the upper half of the housing having a pair of inclined surfaces on its bottom surface adapted for engaging the inclined surfaces on said two sliding blocks, such that when the push button is pressed down, the inclined surfaces on the bottom of the push button engages the inclined surfaces on the two sliding blocks and thereby pulling the blocks toward each other while a synchronized motion being aided by an engagement between the gear wheel and the gear faces on the two leg portions of the blocks operating in a rack-and-pinion manner such that the pair of drive cables are pulled toward said push button for releasing said locking mechanism, and a spring retracts said push button to its upper position.

2. A push button device according to claim 1, wherein said spring is situated between said push button and said gear wheel to facilitate the returning of the push button to its original unpressed position after said locking mechanism is released.

3. A push button device according to claim 1, wherein said pair of drive cables are each connected through a support tube to a locking mechanism for releasing a luggage handle from a locked position.

4. A push button device according to claim 1, wherein said gear wheel having a gear teeth pattern matching that of the gear faces on the leg portions of the sliding blocks such that the sliding blocks can be moved in a rack-and-pinion motion.

5. A push button device according to claim 1, wherein an angle of the inclined surfaces on the bottom of the push button substantially matches an angle of the inclined surfaces on top of the two sliding blocks.

6. A push button device according to claim 1, wherein said pair of drive cables are braided steel cables.

7. A push button device according to claim 1, wherein said upper half and said lower half of the housing are assembled together by mechanical means such that said push button, said sliding blocks, said gear wheel and said pair of drive cables are securely contained therein.

8. A push button device according to claim 1, wherein said lower half of the housing further comprising a shaft adapted for mounting to a center hole in said gear wheel for allowing said gear wheel to turn on said shaft.

9. A retractable handle system for a wheeled luggage equipped with a push button device for releasing a locked handle comprising:

a handle system having a grip and a pair of retractable/extensible support tubes connecting saint grip to a body of a wheeled luggage, said grip comprising an upper half and a lower half defining a cavity contained therein, said upper half having an opening therethrough receiving a push button to move up and down freely in said opening, a pair of sliding blocks situated in the cavity of said grip capable of moving only in a longitudinal direction of said grip, each of said sliding block having a leg portion extending toward the other and an inclined top surface mirror imaged to each others, each of said leg portion having a gear face provided in its surface that faces the other leg portion and engaging a gear wheel, a pair of drive cables, each of said sliding blocks is attached to and is capable of pulling one of said drive cables toward the opening in said upper half of the grip, and a push button positioned in said opening of the upper half of the grip which has a pair of inclined surfaces on its bottom surface adapted for engaging the inclined surfaces on said two sliding blocks such that when said push button is pushed in a downward direction into said opening, the inclined surfaces on the bottom of the push button engage the inclined surfaces on the two sliding blocks and thereby pulling the blocks toward each other while a synchronized motion is aided by an engagement between the gear wheel and the gear faces on the two log portions of the blocks in a rack-and-pinion manner such that the drive cables situated in said support tubes are pulled toward said push button for releasing a locked handle of said wheeled luggage, and a spring retracts said push button to its upper position.

10. A retractable handle system according to claim 9 wherein said spring is situated between said push button and said gear wheel to facilitate the returning of the push button to its original un-pressed position after said locked handle is released.

11. A retractable handle system according to claim 9, wherein said gear wheel having a gear teeth pattern matching that on the opposing surfaces of the leg portions of the sliding blocks such that the sliding blocks can be moved in a rack-and-pinion motion.

12. A retractable handle system according to claim 9, wherein an angle of the inclined surfaces on the bottom of the push button substantially matches an angle of the inclined surfaces on top of the two sliding blocks.

13. A retractable handle system according to claim 9, wherein said pair of drive cables are braided steel cables.

14. A retractable handle system according to claim 9, wherein said upper half and said lower half of the grip are assembled together by mechanical means such that said push button, said sliding blocks, said gear wheel and said pair of drive cables are securely contained therein.

15. A retractable handle system according to claim 9, wherein said lower half of the grip further comprising a shaft received by a center hole in said gear wheel for allowing said gear wheel to turn only in a circumferential direction around said shaft.

16. A locking mechanism comprising:

a housing comprises an upper half and a lower half defining a cavity contained therein, said upper half having an opening therethrough, and a pair of sliding blocks situated in the cavity of said housing capable of moving only in a longitudinal direction of said housing, each of said sliding block having a leg portion extending toward each other, each of said leg portions having a gear face provided in a surface that faces the other leg portion, a knob member having a knob and a gear wheel engaging said gear face on said surface of each of said leg portions, a pair of drive cables, each of said sliding blocks is attached to and is capable of pulling one of said drive cables toward said opening in said upper half of the housing, said knob member being positioned in said opening in the upper half of the housing such that when the knob member is turned, the gear wheel on said knob member engages the gear face on said leg portions in a rack-and-pinion manner such that the pair of drive cables are pulled toward said knob member for releasing said locking mechanism.

* * * * *